US007934320B2

(12) United States Patent
Gratsias et al.

(10) Patent No.: US 7,934,320 B2
(45) Date of Patent: May 3, 2011

(54) RAZOR HANDLE HAVING AN ARCUATE PROFILE

(75) Inventors: Spiros Gratsias, Kypseli-Athens (GR); Ioannis Bozikis, Koukaki-Athens (GR); Yiannis-Marios Psimadas, Vrilissia-Athens (GR)

(73) Assignee: BIC-Violex SA, Anixi, Attiki (GR)

( * ) Notice: Subject to any disclaimer, the term of this patent is extended or adjusted under 35 U.S.C. 154(b) by 247 days.

(21) Appl. No.: 11/815,470

(22) PCT Filed: Feb. 3, 2005

(86) PCT No.: PCT/EP2005/001636
§ 371 (c)(1),
(2), (4) Date: Aug. 3, 2007

(87) PCT Pub. No.: WO2006/081838
PCT Pub. Date: Aug. 10, 2006

(65) Prior Publication Data

US 2008/0141536 A1 Jun. 19, 2008

(51) Int. Cl.
*B26B 21/52* (2006.01)

(52) U.S. Cl. ..... 30/527; 30/32

(58) Field of Classification Search ..... 30/32, 527, 30/50, 526
See application file for complete search history.

(56) References Cited

U.S. PATENT DOCUMENTS

| | | | | |
|---|---|---|---|---|
| 545,789 | A | 9/1895 | Gaffney | |
| 1,636,867 | A | 7/1927 | Robinson | |
| 2,335,547 | A | 11/1943 | Smith | |
| 2,378,605 | A | 6/1945 | Watson | |
| 2,580,058 | A * | 12/1951 | Willhelm | 30/64 |
| 2,703,449 | A | 3/1955 | Haynes | |
| 3,045,342 | A | 7/1962 | Diehl | |
| 3,080,651 | A | 3/1963 | Cas | |
| 3,762,453 | A | 10/1973 | Merrow et al. | |
| D229,795 | S * | 1/1974 | Holohan | D28/46 |

(Continued)

FOREIGN PATENT DOCUMENTS

DE 295 11 444 U1 1/1995

(Continued)

OTHER PUBLICATIONS

International Search Report for International Application No. PCT/EP2005/001636, mailed Oct. 10, 2005.

*Primary Examiner* — Kenneth E. Peterson
*Assistant Examiner* — Sean Michalski
(74) *Attorney, Agent, or Firm* — Jones Day

(57) ABSTRACT

A razor handle having a front end, a back end opposite the front end, an upper surface, a lower surface opposite the upper surface, and a length in a longitudinal direction defined between the front and back ends. The razor handle includes a head portion and a body portion for hand grasping of the razor handle. A first cross-sectional shape of the upper surface is arcuate and has a radius of curvature that increases along the length of the razor handle, from the back end towards a median location located at approximately half the length of the razor handle, and that decreases along the length of the razor handle, from the median location towards the front end. The first cross-section defined by a plane extends from the back end to the front end and is substantially perpendicular to the upper and lower surfaces.

11 Claims, 15 Drawing Sheets

U.S. PATENT DOCUMENTS

| | | | | | |
|---|---|---|---|---|---|
| 4,182,258 | A | | 1/1980 | Presser | |
| 4,198,746 | A | | 4/1980 | Trotta | |
| 4,327,488 | A | | 5/1982 | Connolly | |
| 4,392,303 | A | | 7/1983 | Ciaffone | |
| 4,428,116 | A | | 1/1984 | Chen et al. | |
| 4,601,101 | A | | 7/1986 | McGready | |
| 4,712,301 | A | | 12/1987 | Saito | |
| 4,736,928 | A | | 4/1988 | Smilkstein | |
| 4,828,420 | A | | 5/1989 | Otsuka et al. | |
| 4,949,457 | A | | 8/1990 | Burout, III | |
| 4,969,231 | A | | 11/1990 | Mader et al. | |
| 5,018,733 | A | | 5/1991 | Buand | |
| 5,027,511 | A | | 7/1991 | Miller | |
| 5,031,319 | A | * | 7/1991 | Althaus et al. | 30/526 |
| 5,038,472 | A | | 8/1991 | Iderosa | |
| 5,052,071 | A | * | 10/1991 | Halm | 15/167.1 |
| 5,070,614 | A | | 12/1991 | Hardin et al. | |
| 5,107,590 | A | | 4/1992 | Burout, III et al. | |
| 5,199,191 | A | | 4/1993 | Moumdijan | |
| 5,265,337 | A | | 11/1993 | Lowder | |
| 5,316,316 | A | | 5/1994 | Lai | |
| 5,333,383 | A | * | 8/1994 | Ferraro | 30/527 |
| 5,333,595 | A | | 8/1994 | Heffron | |
| 5,347,717 | A | | 9/1994 | Ts'ai | |
| 5,390,572 | A | | 2/1995 | Gakhar et al. | |
| 5,402,573 | A | | 4/1995 | Laniado | |
| 5,497,551 | A | * | 3/1996 | Apprille, Jr. | 30/526 |
| 5,669,835 | A | | 9/1997 | Tiura | |
| 5,687,485 | A | | 11/1997 | Shurtleff et al. | |
| 5,696,339 | A | | 12/1997 | Brennan | |
| 5,784,790 | A | | 7/1998 | Carson, III et al. | |
| 5,822,869 | A | | 10/1998 | Metcalf et al. | |
| 5,839,163 | A | * | 11/1998 | Hellmann | 16/436 |
| 5,855,071 | A | | 1/1999 | Apprille, Jr. et al. | |
| 5,890,296 | A | | 4/1999 | Metcalf et al. | |
| 5,903,978 | A | * | 5/1999 | Prochaska et al. | 30/34.05 |
| D412,810 | S | | 8/1999 | Alfred | |
| 5,956,851 | A | | 9/1999 | Apprille, Jr. et al. | |
| 6,112,412 | A | | 9/2000 | Richard | |
| 6,122,826 | A | | 9/2000 | Coffin et al. | |
| 6,138,361 | A | | 10/2000 | Richard et al. | |
| 6,141,875 | A | | 11/2000 | Andrews | |
| 6,145,900 | A | | 11/2000 | Jung | |
| 6,149,538 | A | | 11/2000 | Tiura | |
| 6,164,172 | A | | 12/2000 | Huang | |
| 6,266,888 | B1 | | 7/2001 | Zowaski | |
| 6,308,416 | B1 | | 10/2001 | Bosy et al. | |
| 6,473,971 | B2 | * | 11/2002 | Ordaz | 30/47 |
| 6,481,104 | B1 | | 11/2002 | Parker et al. | |
| 6,588,113 | B2 | | 7/2003 | Bozikis et al. | |
| 6,591,456 | B2 | | 7/2003 | DeLuca et al. | |
| 6,598,303 | B2 | | 7/2003 | Bosy et al. | |
| 6,684,511 | B2 | | 2/2004 | McCambridge et al. | |
| 6,694,626 | B2 | | 2/2004 | Kludjian et al. | |
| 6,739,053 | B2 | | 5/2004 | McCambridge et al. | |
| 6,749,788 | B1 | | 6/2004 | Holden et al. | |
| D500,174 | S | | 12/2004 | Gray | |
| 6,880,253 | B1 | | 4/2005 | Gyllerstrom | |
| 6,886,262 | B2 | | 5/2005 | Ohtsubo et al. | |
| 6,977,619 | B2 | | 12/2005 | March et al. | |
| 7,086,160 | B2 | * | 8/2006 | Coffin et al. | 30/532 |
| 7,200,942 | B2 | | 4/2007 | Richard | |
| 7,461,458 | B2 | | 12/2008 | Peyser et al. | |
| D588,308 | S | | 3/2009 | Wonderley | |
| 7,523,525 | B2 | | 4/2009 | Lawless | |
| 7,526,869 | B2 | | 5/2009 | Blatter et al. | |
| 2002/0059733 | A1 | | 5/2002 | Bozikis et al. | |
| 2002/0138992 | A1 | | 10/2002 | Richard | |
| 2002/0184770 | A1 | | 12/2002 | Peyser | |
| 2003/0046819 | A1 | | 3/2003 | Ferraro et al. | |
| 2003/0061718 | A1 | | 4/2003 | Dansreau | |
| 2003/0070259 | A1 | | 4/2003 | Brown et al. | |
| 2003/0070309 | A1 | | 4/2003 | Brown et al. | |
| 2003/0177648 | A1 | | 9/2003 | Zeiter | |
| 2004/0020053 | A1 | | 2/2004 | Wain | |
| 2004/0035003 | A1 | | 2/2004 | Stiles | |
| 2004/0093735 | A1 | | 5/2004 | Ohtsubo et al. | |
| 2004/0103545 | A1 | | 6/2004 | Dansreau | |
| 2004/0170464 | A1 | | 9/2004 | Polczynski | |
| 2004/0177518 | A1 | | 9/2004 | Leventhal | |
| 2004/0221425 | A1 | | 11/2004 | Lawless | |
| 2004/0261271 | A1 | | 12/2004 | Coffin et al. | |
| 2005/0102847 | A1 | | 5/2005 | King | |
| 2005/0198843 | A1 | | 9/2005 | Royle | |
| 2006/0283025 | A1 | | 12/2006 | Follo et al. | |
| 2008/0229583 | A1 | | 9/2008 | Fischer et al. | |

FOREIGN PATENT DOCUMENTS

| | | | |
|---|---|---|---|
| DE | 10 2004 059 517 | A1 | 6/2006 |
| EP | 0 418 726 | B1 | 1/1995 |
| EP | 0 987 088 | A1 | 3/2000 |
| EP | 1 046 471 | A1 | 10/2000 |
| EP | 1 182 015 | A1 | 2/2002 |
| EP | 1 337 382 | A1 | 5/2002 |
| EP | 1 226 906 | A1 | 7/2002 |
| EP | 0 353 919 | B1 | 9/2002 |
| EP | 1 140 441 | B1 | 3/2004 |
| EP | 1 531 030 | A2 | 5/2005 |
| FR | 2 640 182 | A1 | 6/1990 |
| GB | 2 246 314 | A | 1/1992 |
| GB | 2 282 773 | A | 4/1995 |
| GB | 2 402 096 | A | 12/2004 |
| WO | WO 90/13442 | A1 | 11/1990 |
| WO | WO 96/11778 | A2 | 4/1996 |
| WO | WO 97/09155 | A1 | 3/1997 |
| WO | WO 02/34483 | A1 | 5/2002 |
| WO | WO 03/005858 | A2 | 1/2003 |
| WO | WO 03/033223 | A1 | 4/2003 |
| WO | WO 2004/018163 | | 3/2004 |
| WO | WO 2004/094114 | A2 | 11/2004 |
| WO | WO 2005/007355 | A1 | 1/2005 |
| WO | WO 2005/009689 | A2 | 2/2005 |
| WO | WO 2005/084896 | A1 | 9/2005 |

* cited by examiner

RAZOR HANDLE HAVING AN ARCUATE PROFILE

CROSS-REFERENCE TO RELATED APPLICATIONS

This application is a national stage application of International Application No. PCT/EP2005/001636, tiled on Feb. 3, 2005, the entire contents of which are incorporated herein by reference.

BACKGROUND OF THE INVENTION

1. Field of the Invention

Embodiments of the present invention relate to a safety razor. More particularly, embodiments of the present invention relate to an ergonomic razor handle provided with an improved shape for enhancing comfort of hand grasping during shaving operations.

2. Description of the Related Art

Numerous razors comprising a razor handle at a front end of which a razor head is mounted via an appropriate bearing structure are known.

Various kinds of razor handles have been proposed in the past to improve safety and comfort of hand grasping during shaving operations. Two general directions have been explored in order to achieve this end.

In the first direction, the manufacturers have designed razors including materials with good gripping properties, such as elastomeric materials (rubber). For example, U.S. Pat. No. 5,027,511 to Miller shows a rectilinear composite razor handle structure having a housing structure with an array of spaced apertures and a compressible resilient insert structure including projection portions that extend through the apertures.

In the second direction, the manufacturers have designed razors with particular shapes deemed to facilitate palm grasping. For example, U.S. Pat. No. 5,687,485 to Shurtleff et al. shows a razor handle having a bulbous proximal end and a Y-shaped yoke having a finger rest, the handle being constructed as a unitary plastics molding.

Nowadays, the manufacturers tend to combine the use of elastomeric materials and a somewhat ergonomic shape of the handle. For example, U.S. Patent Application Publication No. 2004/0103545 to Dansreau shows a curved handle having an outer layer made from a compressible elastomeric material and formed around an inner rigid core.

These above-discussed designs, however, fail to provide excellent grasping and comfort during shaving operations.

SUMMARY OF THE INVENTION

It is an object of embodiments of the present invention to provide a razor handle with improved ergonomics, in order to enhance the grasping and comfort qualities of the razor handle during shaving operations.

The proposed razor handle has a front end and a back end opposite the front end, and comprises a head portion for connection to a razor head, and a body portion for hand grasping of the razor handle. The razor handle has an upper surface and a length defined between the back end and the front end. From a side view, the upper surface is arcuate and has a radius of curvature that increases, along the length of the razor handle, from the back end towards a median location in the vicinity of half the length of the razor handle and, which decreases along the length of the razor handle, from the median location towards the front end.

Such a shape increases ergonomics of the handle, because its curvature follows the natural curvature of the human hand, thereby enhancing grasping comfort.

The above and other objects and advantages of embodiments of the present invention will become apparent from the following detailed description of the embodiments of the present invention, considered in conjunction with the accompanying drawings.

DESCRIPTION

Figure 1:
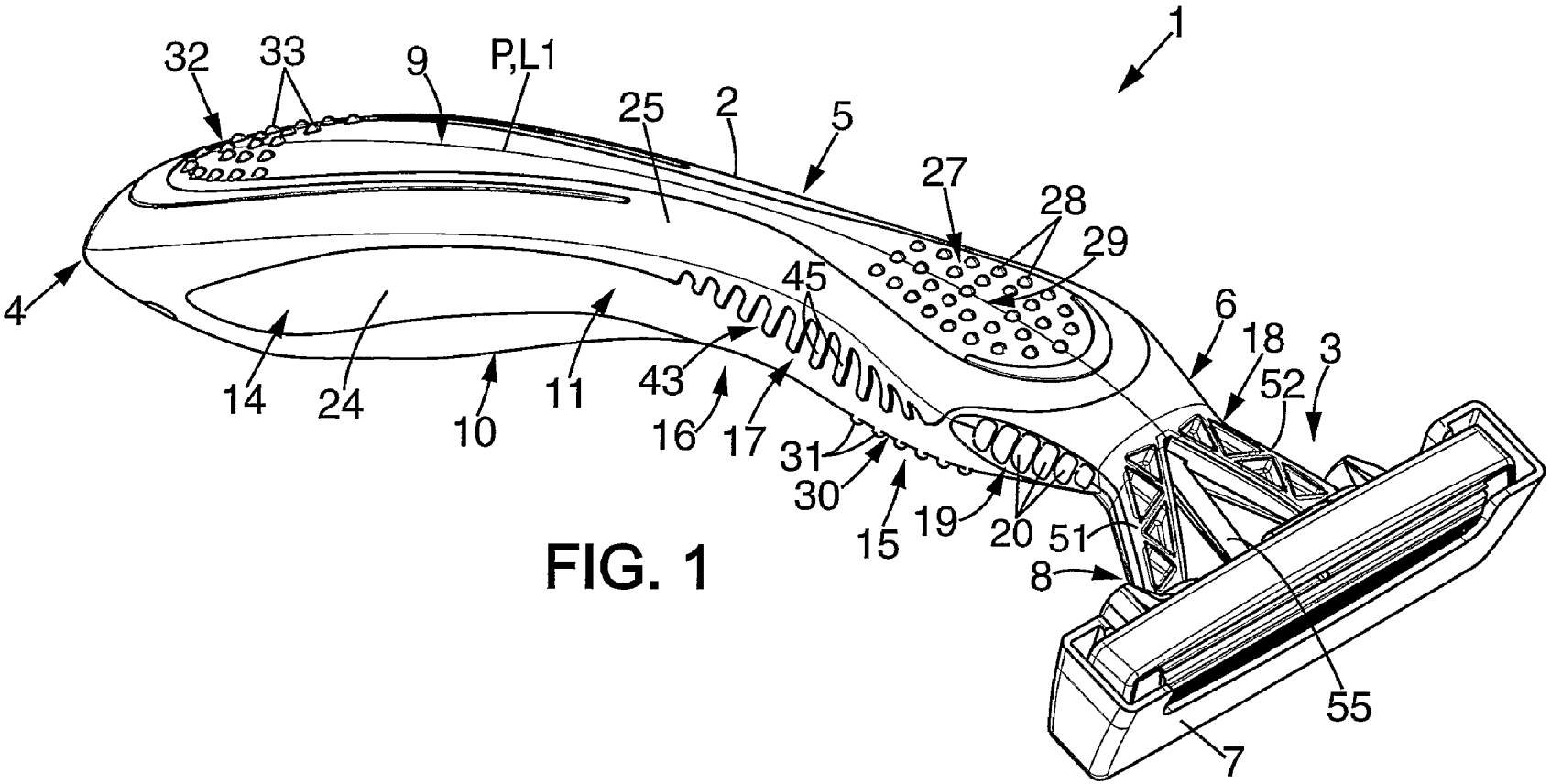
FIG. 1 is a front top perspective view of a razor, according to an embodiment of the present invention.
Figure 2:
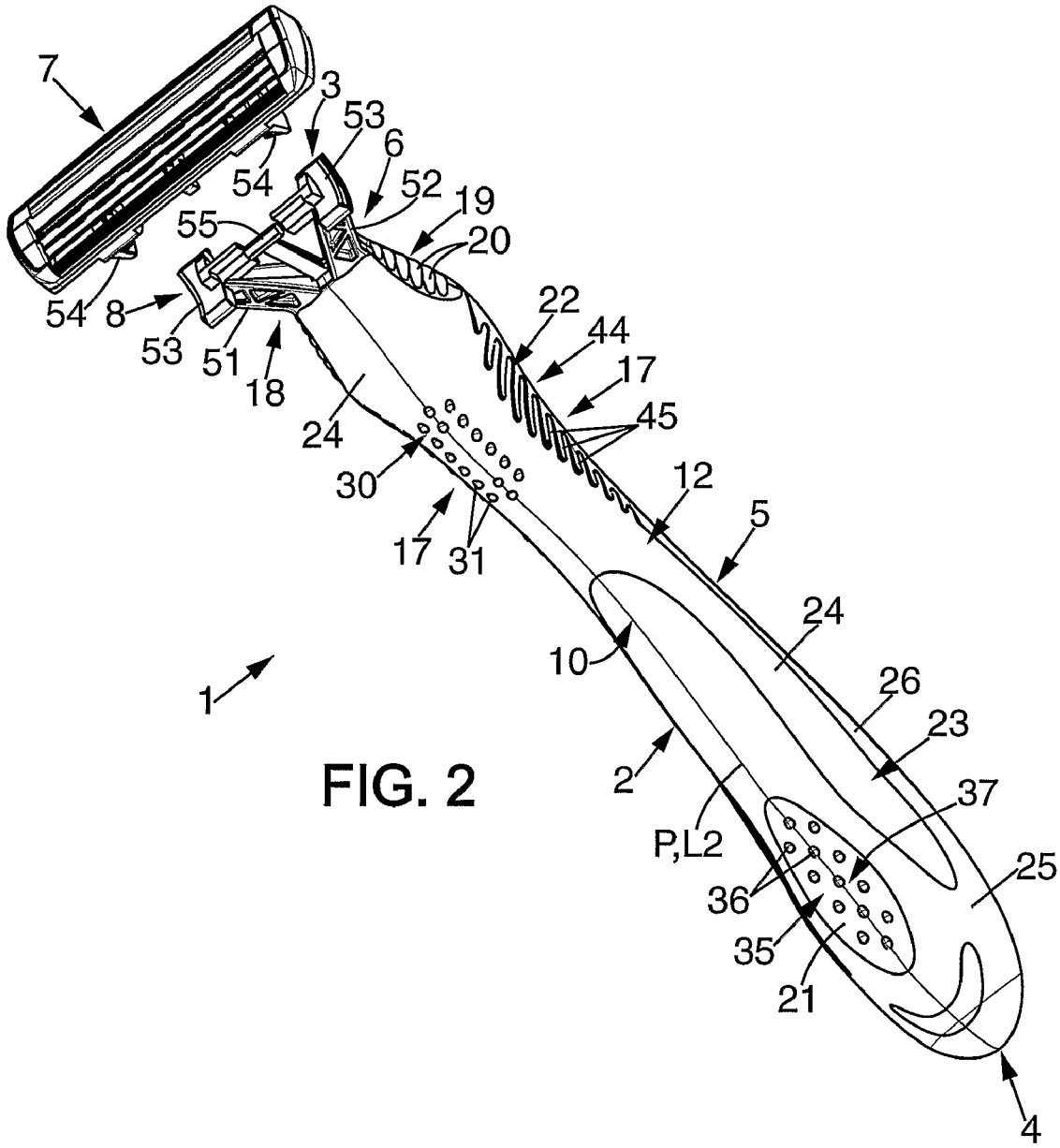
FIG. 2 is an exploded bottom perspective view of the razor of FIG. 1.

Referring to FIGS. 1 and 2, there is shown a safety razor 1 comprising a handle 2 defining a front end 3 and a back end 4 opposite the front end 3, and having an elongated body portion 5 for hand grasping of the handle 2, extending longitudinally from the back end 4 to a location near the front end 3. The razor further comprises a head portion 6 in the continuation of the body portion 5 up to the front end 3. The razor 1 also comprises a razor head 7 including blades mounted in a head structure defining, in a known manner, a guard and a cap, and connected, at the front end 3, to the head portion 6 by means of bearing structures 8.

The following description will often make reference to different hand grasping positions of the handle 2. Various positions are illustrated in FIGS. 17A to 17G, where the numbers in circles designate the fingers of the human hand: ① the thumb, ② the index, ③ the second finger, ④ the ring finger and ⑤ the small finger. The depicted positions of FIGS. 17A, 17B, 17C, 17D, 17E, 17F and 17G are respectively called first position, second position, third position, fourth position, fifth position, sixth position and seventh position.

Figure 3:
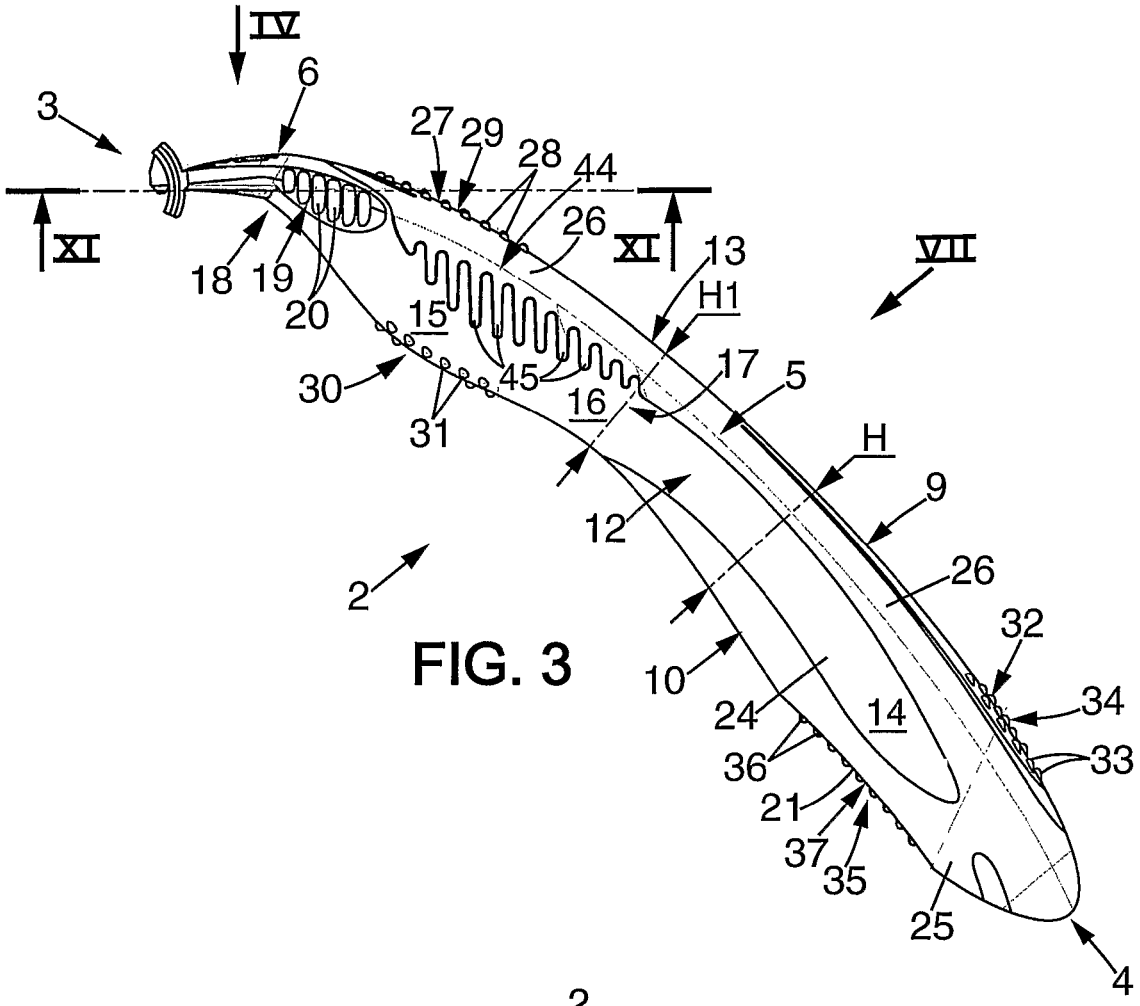
FIG. 3 is a side elevational view of the handle of the razor of the preceding Figs.

Referring now to FIG. 3, it can be seen that the razor handle 2 has a generally curved shape. The handle 2 defines a length of between approximately 12 cm and 14 cm, as measured along its curvature between the front end 3 and the back end 4. The body portion 5 is approximately 10 cm to approximately 12 cm in length, whereas the head portion 6 is approximately 2 cm to 3 cm in length. In one embodiment, the razor handle 2 is 13.5 cm in length, the body portion 5 is 11 cm in length and the head portion 6 is 2.5 cm in length.

Handle 2 has, extending along its length, an upper surface 9, a lower surface 10 opposite the upper surface 9, and side surfaces 11, 12 joining the upper surface 9 and lower surface 10. Handle 2 is symmetrical with respect to a median plane P made visible in FIGS. 1 and 2 through its lines L1, L2 of intersection with the handle 2, respectively on the upper surface 9 and the lower surface 10. As depicted in FIG. 3, upper surface 9 is, from a side view, arcuate and convex in the longitudinal direction. It can also be seen in FIGS. 13A to 13L that upper surface 9 is also arcuate and convex in cross section (i.e. perpendicular to the symmetry plane P of handle 2).

Figure 5:
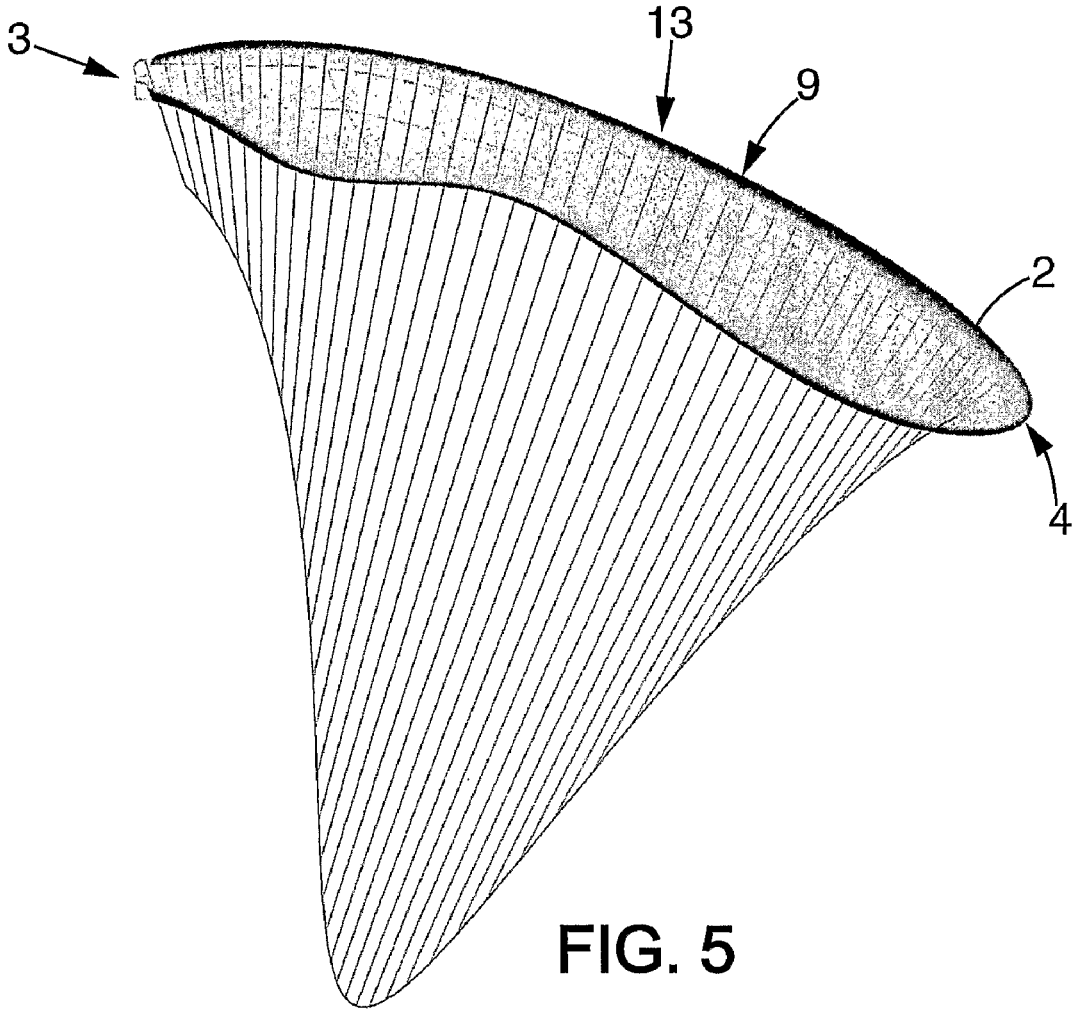
FIG. 5 is a diagram showing the distribution of the centers of curvature for the edge curve of the top surface of the razor handle for the razor of FIG. 1.
Figure 6:
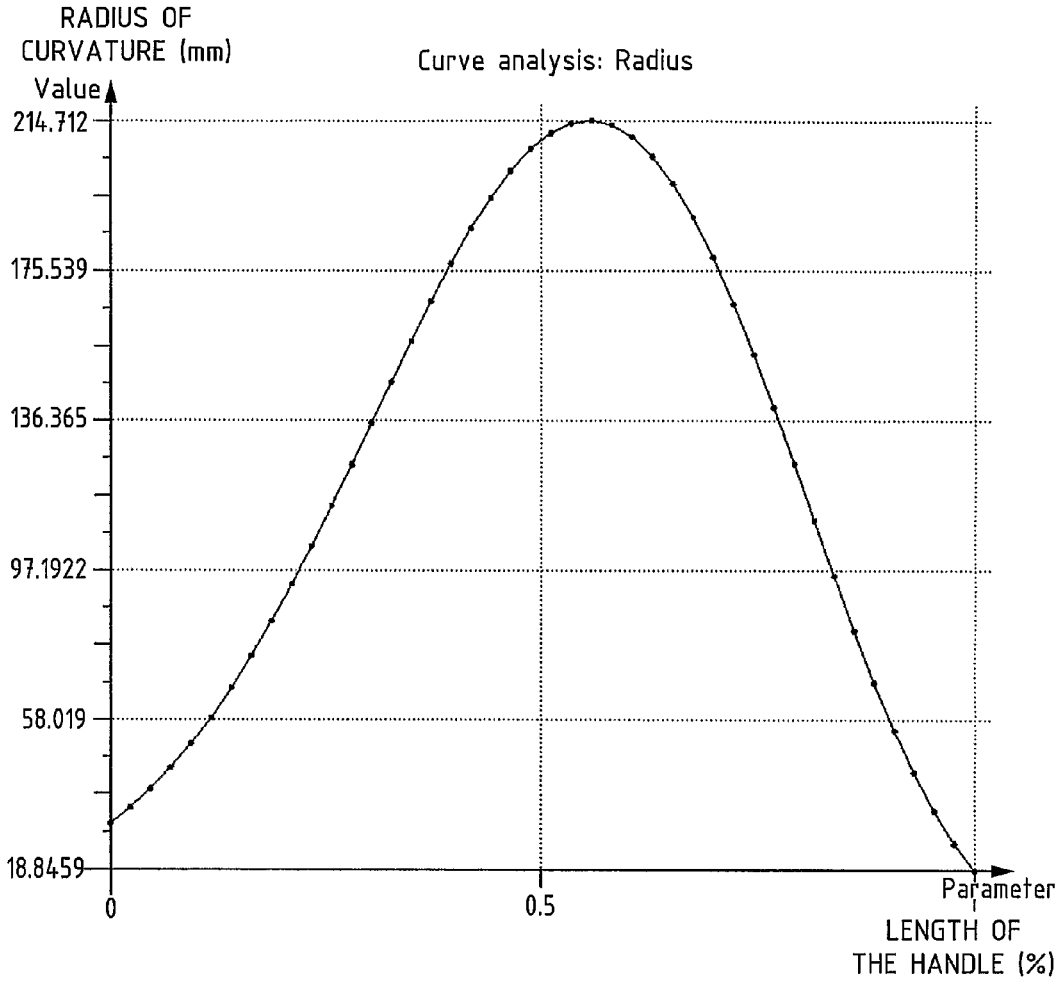
FIG. 6 is a diagram showing the evolution of the radius of curvature for the edge curve of the top surface of the razor handle for the razor of FIG. 1, along the length thereof.

As depicted in FIGS. 5 and 6, which diagrammatically show the evolution, from a side view, of the radius of curvature of upper surface 9 (in other words, the radius of curvature of the line L1) along the length of the razor handle 2, the radius of curvature is not constant but continuously increases longitudinally (i.e. along the length of the razor handle 2), from the back end 4 toward a median location 13 in the vicinity of half the length of the razor handle 2, whereas the radius of curvature continuously decreases, longitudinally, from the median location 13 toward the front end 3 of the handle 2. In other words, the upper surface 9 is curved more near its ends 3, 4, where the radius of curvature is approximately 2 cm, and more flat in the vicinity of its middle, where the radius of curvature is equal to or more than approximately 20 cm. Such a shape of the upper surface 9 increases ergonomics of the handle 2, its curvature following the natural curvature of the human hand, thereby enhancing grasping comfort.

Figure 17A:
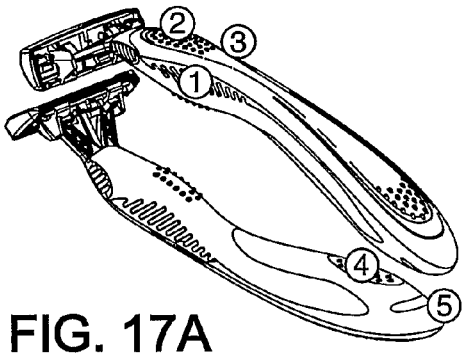
FIGS. 17A to 17G are perspective views showing a razor of the preceding Figs. and its mirror image, and illustrate various ways of grasping the razor handle, depending of the shaving positions.
Figure 17B:
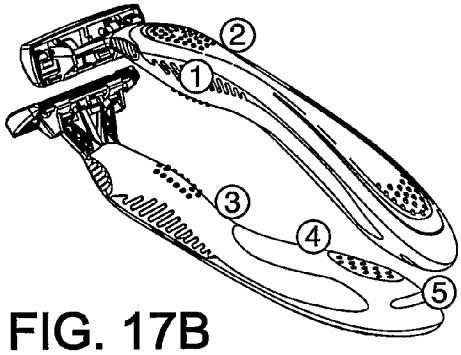
Figure 17C:
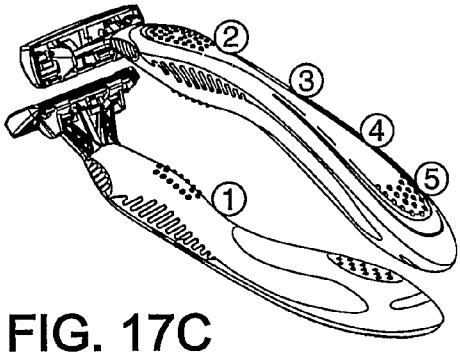
Figure 17D:
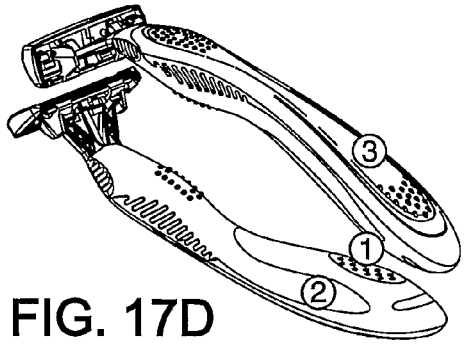

The upper surface 9 and the lower surface 10 together define, from a side view in the symmetry plane P, a height H of the handle 2. It is visible in FIG. 3 that the height is not constant along the length of the handle 2, where the lower surface 10 is convex in the vicinity of the ends 3, 4 of the handle 2 and concave towards the middle thereof. More specifically, the smallest height H1 of the handle 2 is located about two thirds of the length of the body portion 5, measured from to back end 4 toward the front end 3, so that the handle 2 defines two thicker portions 14, 15 separated by a relatively thinner portion 16. This allows for easier and more comfortable finger positioning before and during shaving operations, especially in the third position (FIG. 17C).

Figure 4:
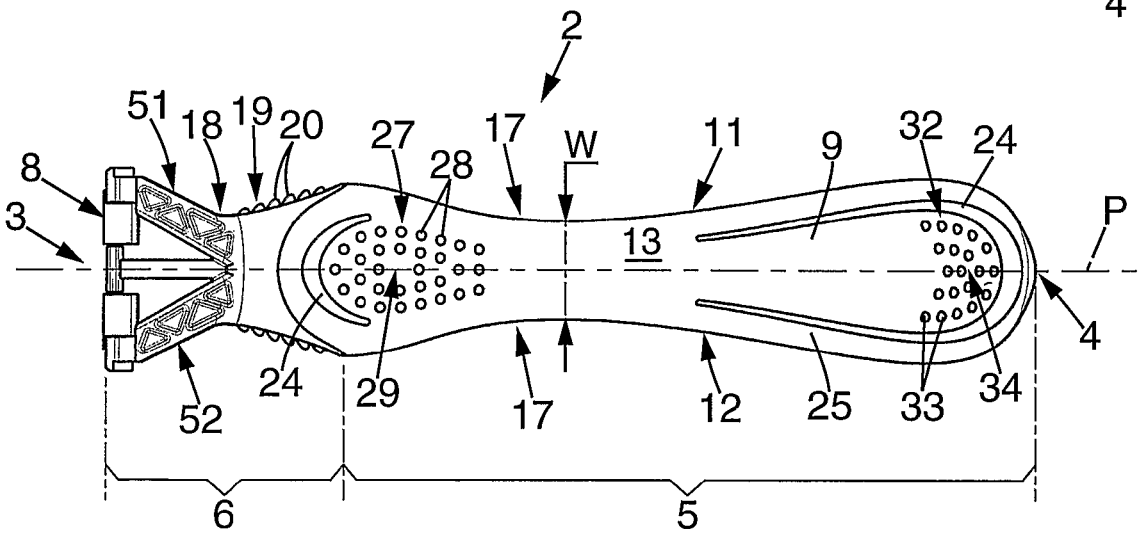
FIG. 4 is a top plan view of the razor handle of FIG. 3 from the perspective of arrow IV in FIG. 3.
Figure 7:
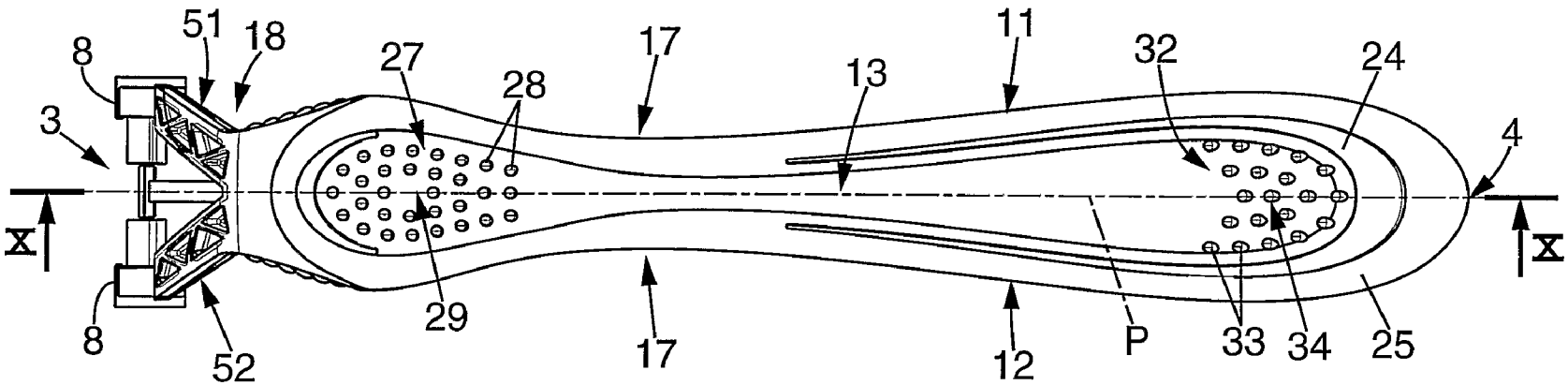
FIG. 7 is a top plan view of the razor handle of FIG. 3, from the perspective of arrow VII in FIG. 3.

Referring to FIGS. 4 and 7, it can be seen that, from a top view, the body portion 5 has a neck portion 17 in the vicinity of the head portion 6, located at approximately two thirds of the length of the body portion 5, measured from the back end 4, and where the width W of the razor, i.e. the distance between the side surfaces 11, 12, is minimized.

More specifically, from a top view, each side surface 11, 12 extends substantially along an arc of a circle in the neck portion 17. Such a circle has a radius of approximately 5 cm to 10 cm, and preferably approximately 6 cm. This particular shape of the neck portion 17 aims at facilitating hand grasping, especially in the first position (FIG. 17A), which appears to be the most common shaving position.

As depicted in FIGS. 4 and 7, the width W of the handle 2 is maximized in the vicinity of the back end 4 and at the junction between the body portion 5 and the head portion 6. A secondary neck portion 18, defined in the head portion 6 is provided with opposite side gripping areas 19 comprising a series of spaced ribs 20. This enhances finger gripping of the handle 2, especially in a shaving position where the thumb and the index finger are positioned very close to the razor head 7 for satisfying the need for precise shaving, such as mustache trimming. In this position, the body portion 5 of the handle 2 is either free or grasped between the small finger and the palm of the hand.

Figure 13A:
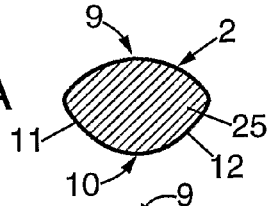
FIGS. 13A to 13L are cross-sectional views of the razor handle of FIG. 12, taken along the lines XIIIA-XIIIA to XIIIL-XIIIL, respectively.
Figure 13B:
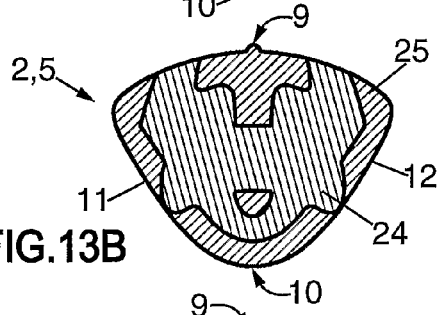
Figure 13C:
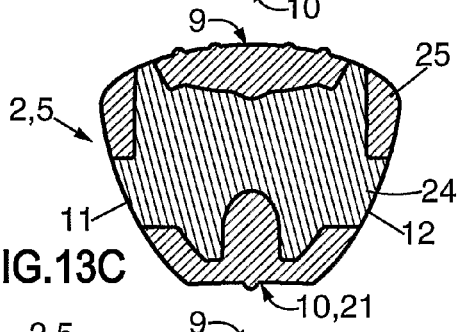
Figure 13D:
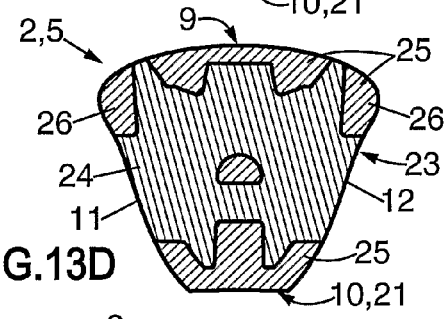
Figure 13E:
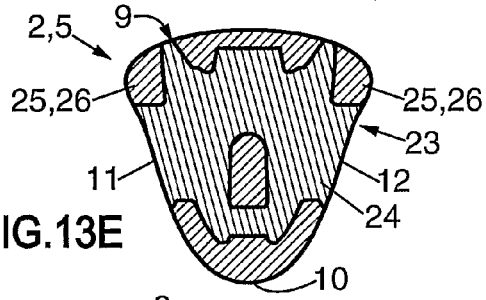
Figure 13F:
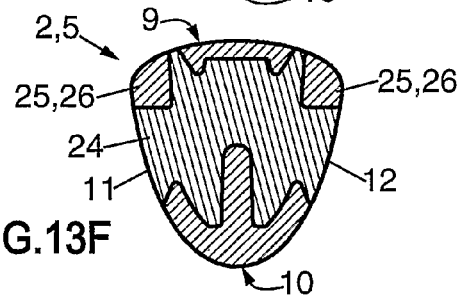
Figure 13G:
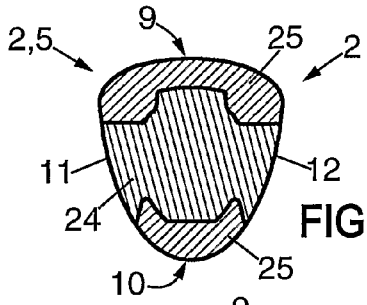
Figure 13H:
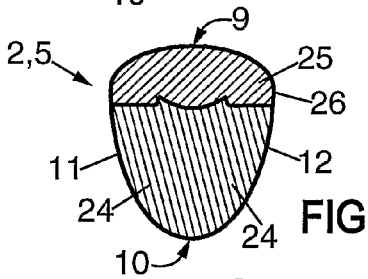
Figure 13I:
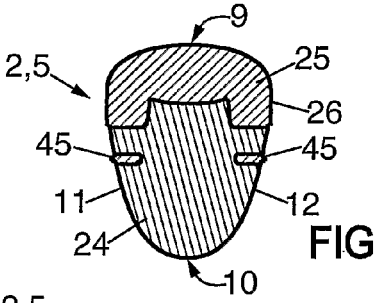
Figure 13J:
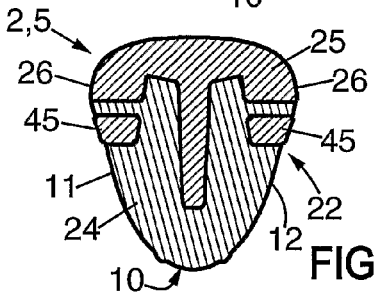
Figure 13K:
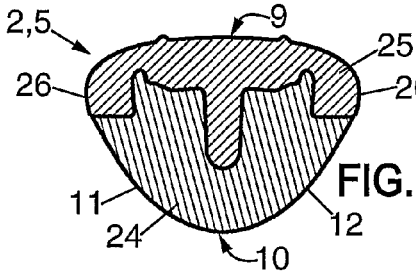
Figure 13L:
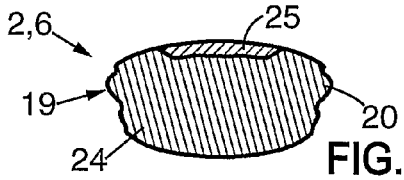

As depicted in FIGS. 13A to 13K, which are cross sections of the handle 2 taken regularly all along the body portion 5, the side surfaces 11, 12 converge at the opposite ends of the upper surface 9, all along the length of the body portion 2. In other words, the body portion 5 has a generally triangular shape in cross section, except in a zone located near the back end 4 of the handle 2, where the lower surface 10 is provided with a flat or concave recess 21 designed for facilitating finger gripping in certain hand grasping positions. In this zone, the general shape of the body portion 5 in cross section is trapezoidal, as depicted in FIGS. 13C and 13D.

It can be seen in FIGS. 13B to 13K that, except in the immediate vicinity of the back end 4 of the razor handle 2 (FIG. 13A), the angular aperture defined between the side surfaces is less than approximately 90°. Such a triangular shape allows for firm gripping and comfortable grasping of the handle 2, especially in the first position (FIG. 17A).

It can further be seen in FIGS. 13A to 13K that each side surface 11, 12 is convex, except in the vicinity of the head portion 6 (i.e. in the neck portion 17), where the head portion 6 has a concave portion 22 designed for facilitating hand grasping, especially in the first, second, and sixth positions (FIGS. 17A, 17B and 17F, respectively), and also except in the vicinity of the back end 4, where each side surface 11, 12 has a concave portion 23 of approximately 1 cm in length located at a distance of approximately 3 cm from the back end 4. The side surfaces 11, 12 are also designed for facilitating hand grasping, especially in the fourth position (FIG. 17D) and seventh position (FIG. 17G).

The razor handle 2 is of the composite type and is comprised of a rigid core 24 made of a moldable nonelastomeric material such as polypropylene or ABS resin, and a layer 25 made of a compressible elastomeric material (thermoplastic rubber) such as Santoprene. The rigid core 24 provides structural strength to the handle 2 while the layer 25 of compressible elastomeric material provides the softness required for comfortable hand grasping and firm finger gripping in any shaving position.

As can be seen, for example, in FIGS. 13A-13L, the layer 25 of compressible elastomeric material defines a majority of the upper surface 9 on the body portion 5 and it also defines part of the lower surface 10, from the back end 4 to the median location 13, and it even overflows the side surfaces 11, 12 at 26.

The rigid core 24 defines: part of the side surfaces 11, 12 between the side overflowing portions 26 of the layer 25 of compressible elastomeric material, from a location near the back end 4 to the median location 13; part of the side surfaces 11, 12; the whole lower surface 10 from the median location 13 to the head portion 6; and substantially the whole head portion 6, including the side ribs 20, which are therefore integral with the rigid core 24.

As depicted in FIGS. 1 and 4, the body portion 5 is provided with a local upper front gripping or finger rest area 27 comprising a plurality of spaced projections 28 in the form of pins protruding from the upper surface 9. The gripping area 27 is centered on a point 29 that is located at a distance of at least 3 cm from the front end 3. Such a location provides improved gripping and finger rest comfort in certain shaving positions, such as the first position (FIG. 17A), where the index finger of the user is located at a distance from the skin to be shaved, allowing for precise and comfortable shaving.

As depicted in FIG. 1, the layer 25 of compressible elastomeric material forms the upper front gripping area 27, the projections being therefore integral with layer 25, thereby increasing the gripping properties of the handle 2, at least in the first position (FIG. 17A). It can be seen in FIG. 4 that the upper front gripping area 27 is shaped like a bullet having a longitudinal length of approximately 2 cm, which suits the tip of the index finger tip.

The body portion 5 is also provided with a local lower front gripping area 30 located opposite the upper front gripping area 27, comprising a plurality of spaced projections 31 protruding from the lower surface 10. Because, at this location, the lower surface 10 of the body portion 5 is formed by the rigid core 24, the projections 31, in the form of pins, are integral with the rigid core 24. The lower front gripping area 30 provides, in combination with the upper front gripping area 27, enhanced gripping properties in certain shaving positions, such as the one (not depicted) where the razor handle 2 is grasped between the thumb and the index finger in the vicinity of the head portion 6, whereas the rest of the handle 2 is free. Such a shaving position, in which the index finger rests onto the upper front gripping area 27 while the thumb rests onto the lower front gripping area 30, is sometimes used for precise shaving operations, such as mustache trimming.

The body portion 5 is also provided with a local upper back gripping area 32 comprising a plurality of spaced projections 33 in the form of pins protruding from the upper surface 9, and centered on a point 34 located at a distance of approximately 2 cm from the back end 4 of the body portion 5. The body portion also comprises a local lower back gripping area 35, located substantially opposite the upper back gripping area 32, comprising a plurality of spaced projections 36 in the form of pins protruding from the recess 21 in the lower surface 10 and centered on a point 37 located at a distance of approximately 2.5 cm from the back end 4. Because, in this region, the upper and lower surfaces 9, 10 are defined by the layer 25 of compressible elastomeric material, the pins 33, 36 of the upper and lower back gripping areas 32, are integral with the elastomeric layer 25. This enhances hand grasping in certain shaving positions, such as the fourth position (FIG. 17D), or in a position where the razor handle is held between the index finger and the thumb, the thumb resting on the lower back gripping area 35 whereas the index finger rests on the upper back gripping area 32, the handle 2 being in continuation with the fingers. Such a shaving position is used in particular for horizontal cheek shaving.

Figure 17E:
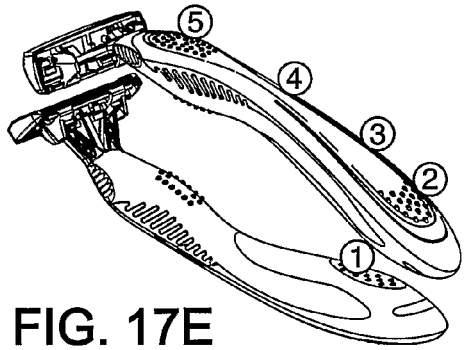

The lower back gripping area 35 can also be used in combination with the upper front gripping area 27 in certain shaving positions such as the first position (FIG. 1) and the fifth position (FIG. 17E). This is why the distance between these areas 27 and 35 has to be carefully defined. In order to provide excellent finger gripping and comfortable hand grasping in these shaving positions, the distance between the lower back gripping area 35 and the upper front gripping area 27, measured along the curvature of the handle 2, is between approximately 7 cm and 9 cm. In the depicted embodiment, this distance is approximately 8 cm, which suits the majority of male hands.

Figure 10:
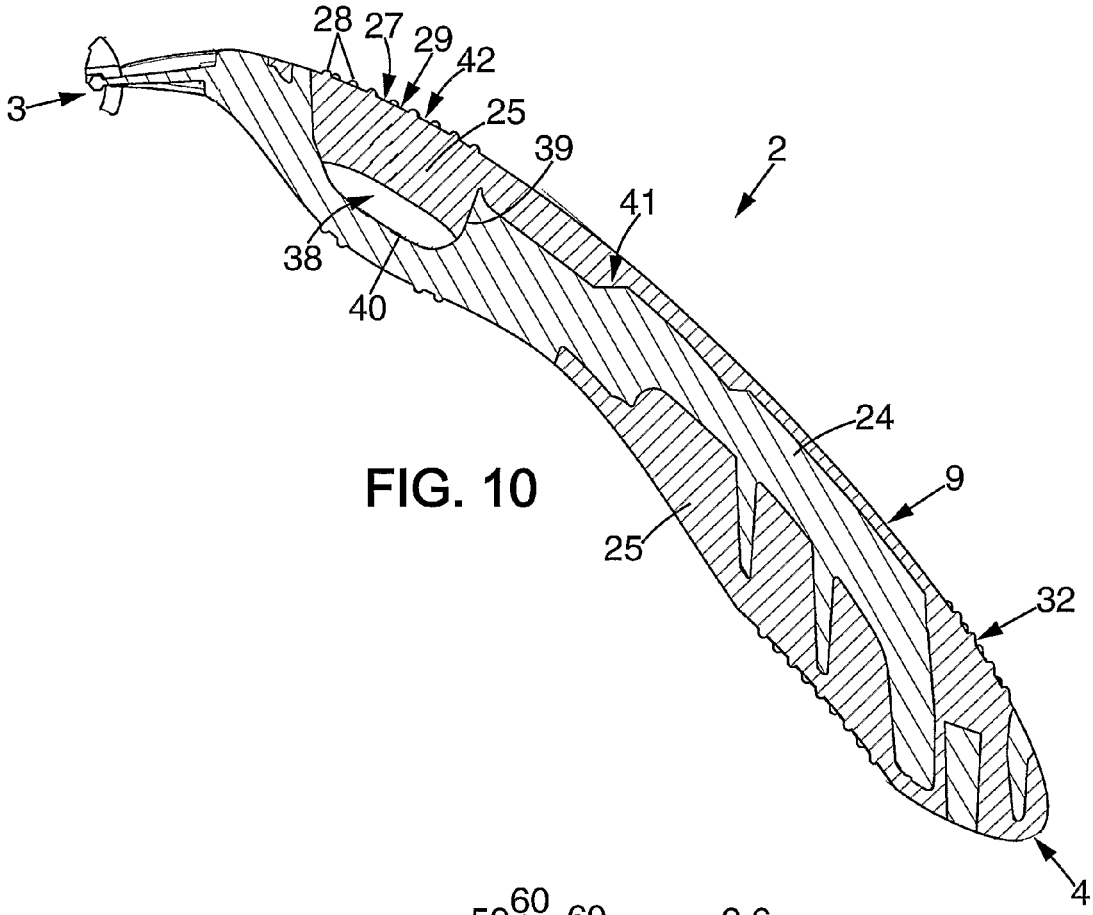
FIG. 10 is a cross-sectional view of the razor handle of FIG. 7, taken along the line X-X.

As depicted in FIG. 10, the handle 2 includes an air cushion 38 underneath the upper front gripping area 27 located or disposed between the rigid core 24 and the layer 25 of compressible elastomeric material. More specifically, in the region underneath the upper front gripping area 27, the rigid core 24 defines a groove 39 that is filled with the compressible material, except for in the bottom 40 of the groove 39, where the air cushion 38 is located. Such an air cushion 38, acting like a compression spring, adds softness and compressibility to the upper surface 9 of the handle 2 in the region of the upper front gripping area 27, where the index finger rests in the first position (FIG. 17A), thereby enhancing the gripping and comfort properties of the handle 2 by providing more conformability to the finger tip.

The air cushion 38 is built up during the manufacturing process of the handle 2, in which there is provided a step of molding the rigid core 24, followed by a step of molding the layer 25 of compressible elastomeric material over the rigid core 24 after a short predetermined rest time (few seconds) where the rigid core 24 is allowed to cool. The resin of which the core 24 is made of is injected at a primary injection point 41 located near the middle of the handle 2, whereas the compressible elastomeric material is injected at a secondary injection point 42 that faces the groove 39 near the head portion. The flow of pressurized elastomeric material generates an air bubble which is imprisoned at the bottom 40 of the groove 39, thereby building up the air cushion 38 between the rigid core 24 and the elastomeric layer 25.

As depicted in FIGS. 1-3, in the region of the neck portion 17, the handle 2 is provided with opposite side gripping areas 43, 44 comprising a row of spaced fins 45 made of elastomeric material, protruding from the rigid core 24.

Figure 14:
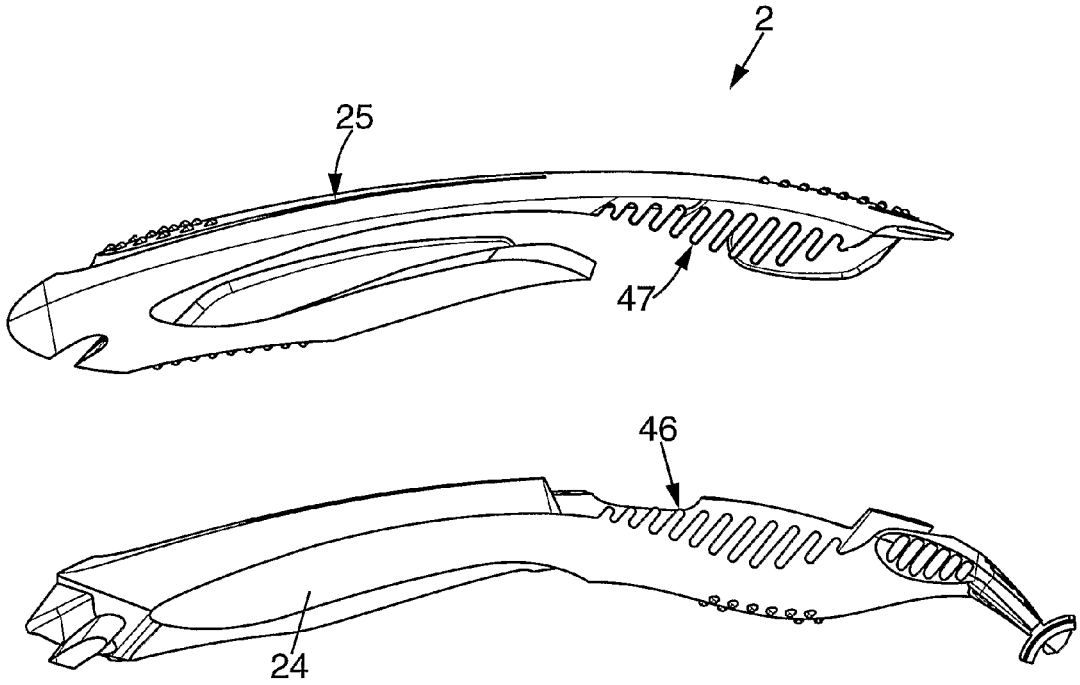
FIG. 14 is a side elevational exploded view showing the components of the razor handle of the preceding Figs.
Figure 15:
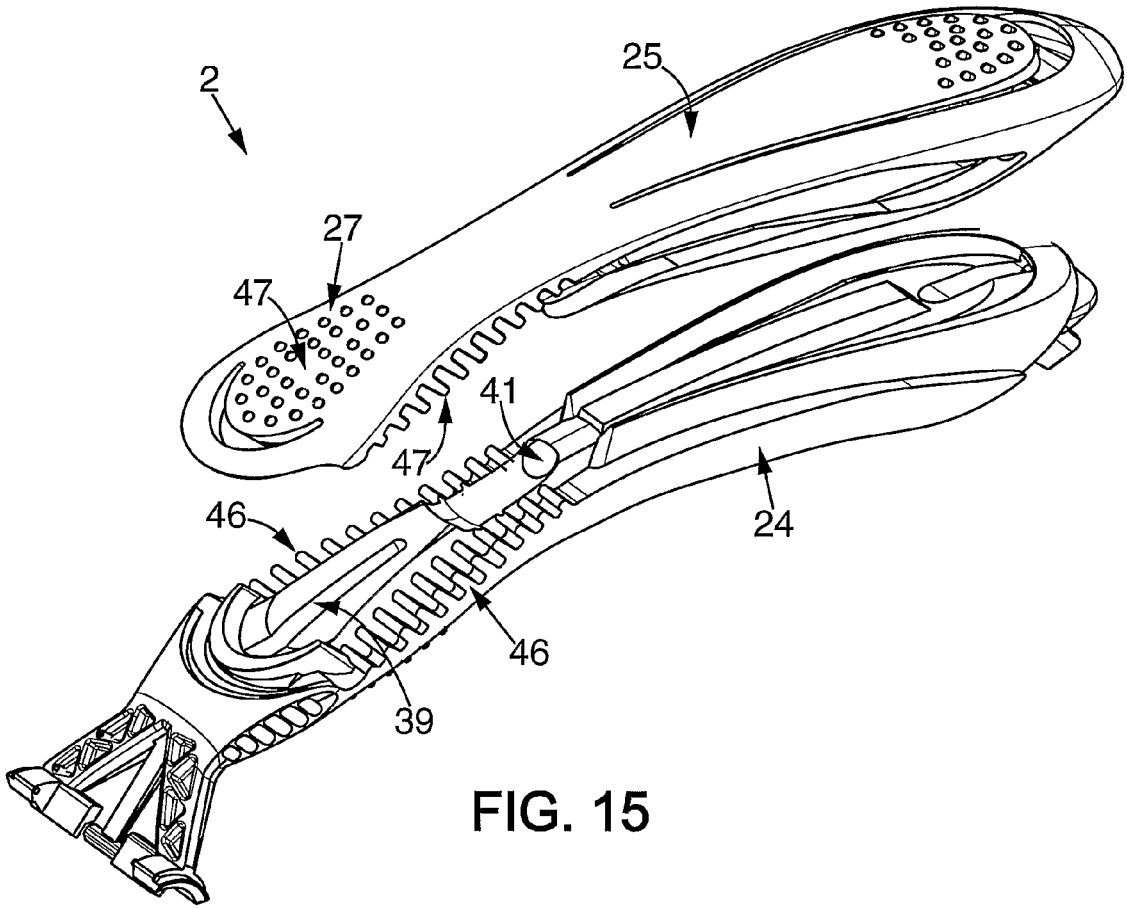
FIGS. 15 and 16 are respectively a front top perspective view and a back bottom perspective view showing the elastomeric member and the rigid member that comprise the razor handle of the preceding Figs.
Figure 16:
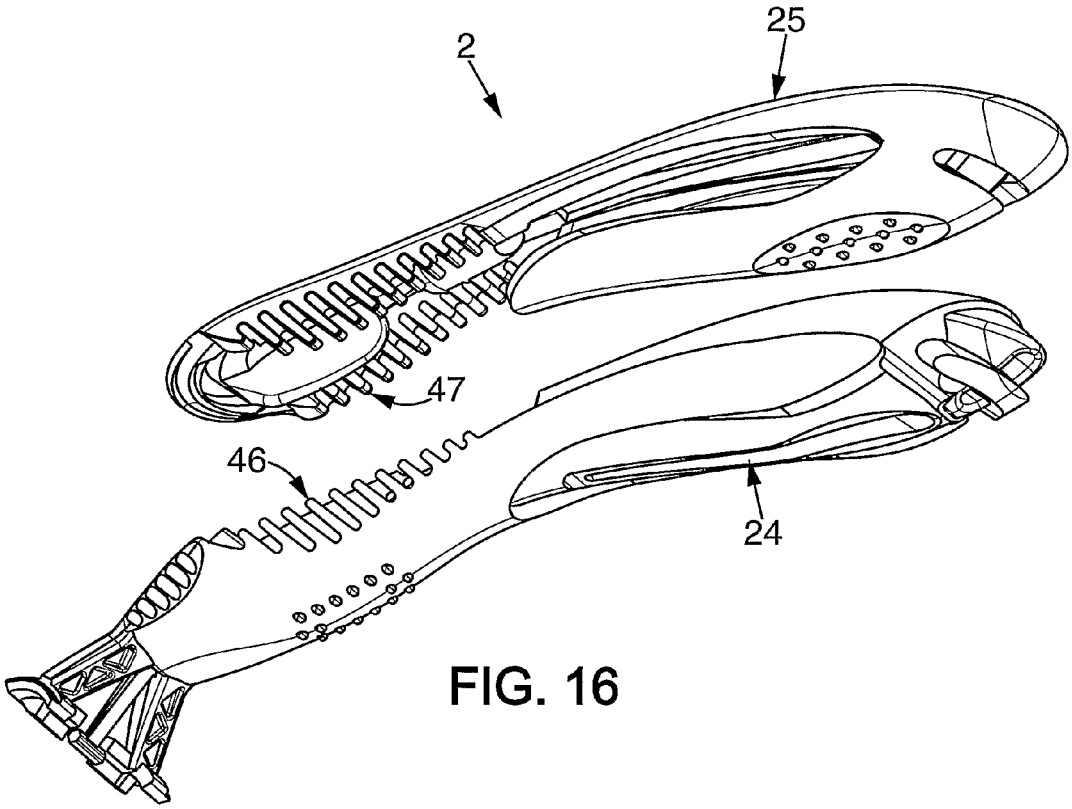
Figure 17F:
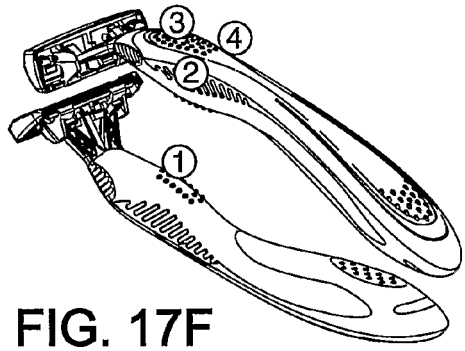
Figure 17G:
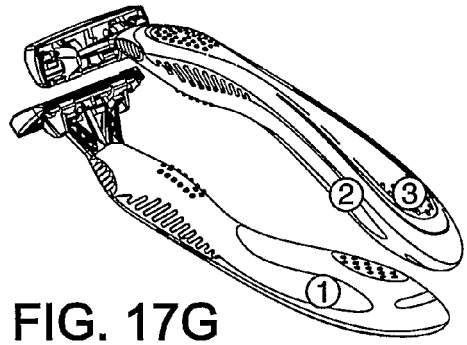

More specifically, in the region of the neck portion 17, the rigid core 24 and the layer 25 of compressible material define complementary comb-like structures 46, 47 embedded and imbricated in each other as depicted in FIGS. 14-16. In the neck portion 17, the elastomeric layer 25 is wider than the rigid core 24, so that the elastomeric fins 45 extend laterally outside from the rigid core 24, thereby providing better finger gripping in certain positions, especially the first position (FIG. 17A), second position (FIG. 17B) and sixth position (FIG. 17F).

Figure 9:
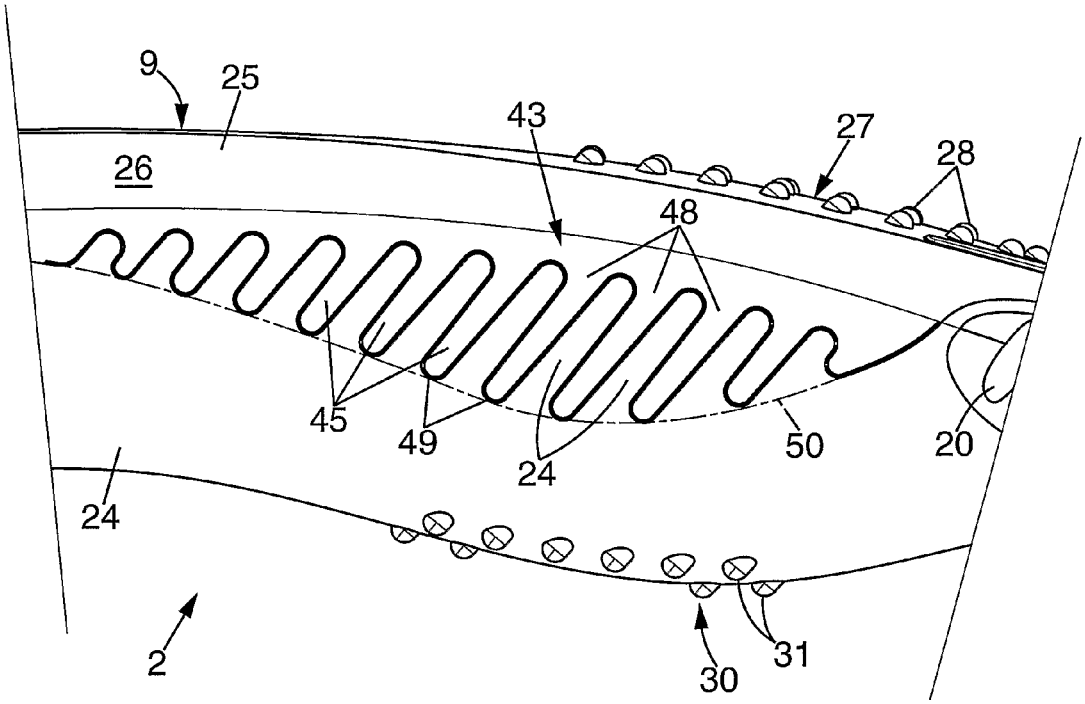
FIG. 9 is an enlarged side view of the razor handle of the preceding Figs.

As depicted in FIG. 9, each fin 45 extends from a root 48, located in the side overflowing portion 26 of the elastomeric layer 25 near the upper surface 9, to an end 49 located on the side surface 11, 12 at a distance from the upper surface 9. It can also be seen in FIG. 9 that the fins 45 are parallel and each inclines backwards, from the root 48 to the end 49, with respect to a plane perpendicular to the upper edge L1 of the handle 2 (which corresponds, as disclosed hereabove, to the intersection of the symmetry plane P and the upper surface 9 of the handle 2). Such an inclination improves the ergonomics of the handle 2, especially in the first position (FIG. 17A), where the fins 45 extend substantially perpendicular to the axis of the index finger. In one embodiment, the distance between two adjacent fins 45 is approximately 1 mm, whereas the fins 45 have a depth less than 0.5 mm, and more preferably 0.2 mm, and a width that is greater than the depth, and more specifically, approximately 1 mm.

The imbricate structure of the side gripping areas 43, 44 provides a good compromise between softness (via the elastomeric fins 45) and rigidity (via the rigid core 24) for firm and comfortable grasping of the razor handle 2, especially in the first position (FIG. 17A).

As depicted in FIG. 9, the ends 49 of the fins 45 together form a continuously curved limit 50 (in phantom) of the corresponding side gripping areas 43, 44, in order to match as closely as possible, the roundness of the finger tips, especially in the first position (FIG. 17A), thereby enhancing comfort of hand grasping.

Figure 8:
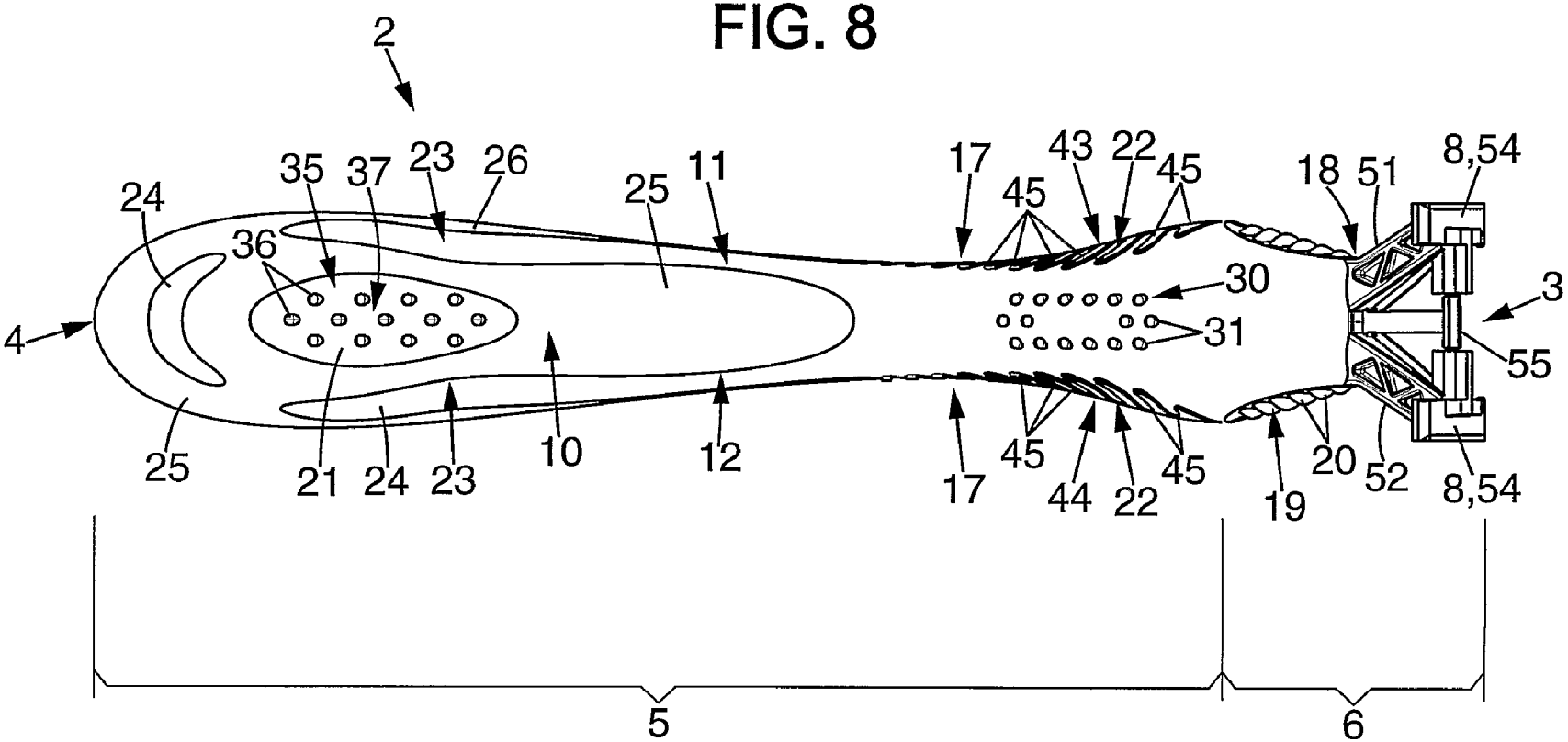
FIG. 8 is a bottom plan view of the razor handle of the preceding Figs.
Figure 11:
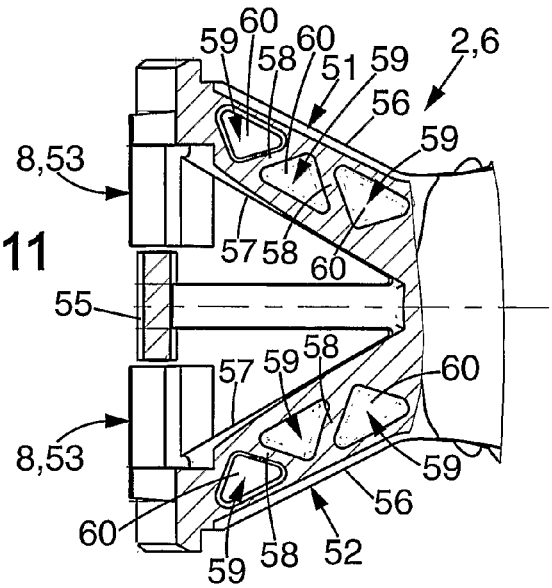
FIG. 11 is a partial cross-sectional view showing the head portion of the razor handle of FIG. 3, taken along the line XI-XI.
Figure 12:
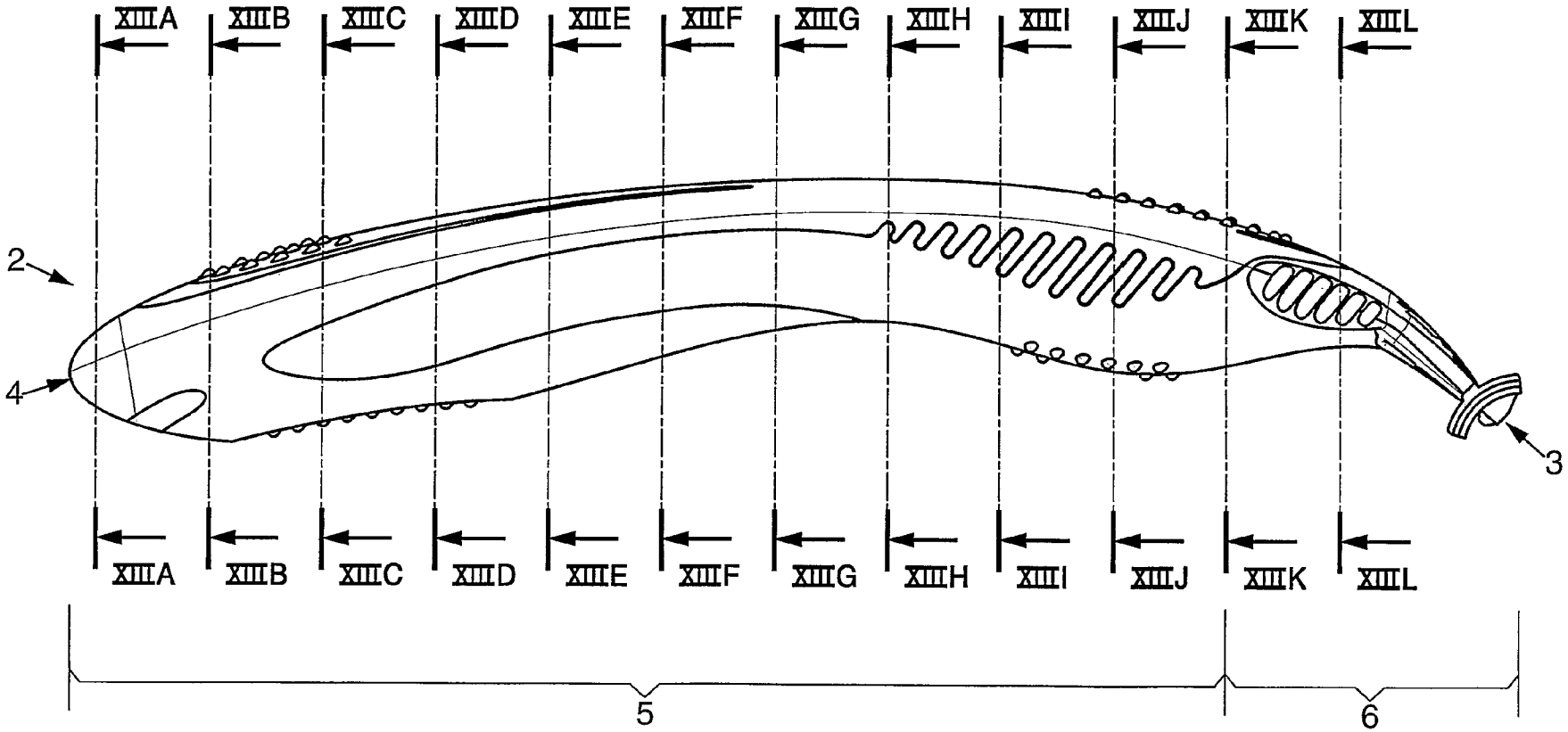
FIG. 12 is a side elevational view of the razor handle of the preceding Figs., showing the opposite side of the razor handle depicted in FIG. 3.

Turning now to FIGS. 7, 8 and 11, it can be seen that the head portion 6 of the razor handle 2 has a V-shaped pair of spaced arms 51, 52 each provided, at an end thereof, with a bearing structure 8 for connection to the a razor head 7.

In the disclosed embodiment, the razor head 7 is of the swiveling type, the bearing structures 8 comprising arcuate rails 53 clipped into corresponding hooks 54 provided on the razor head 7, wherein a longitudinal flexible tongue 55, extending between the arms 51, 52 and cooperating with a groove formed on the razor head 7, provides a spring force which biases the razor head 7 towards a median rest position as illustrated in FIG. 1.

As depicted in FIG. 11, each arm 51, 52, which is integral with the rigid core 24, has a reticulated structure, and comprises a pair of side walls 56, 57 interconnected by a series of transverse stiffeners 58 that are inclined at approximately 45° with respect to the side walls 56, 57, thereby together defining, from a top view, a series of triangular-shaped cavities 59. Such a structure provides enough structural strength to the head portion 6 for the purposes of human shaving, while saving handle 2 weight and costs.

In the depicted embodiment, where the razor 1 is of the disposable type, which means that once mounted on the handle 2, the razor head 7 does not have to be dismounted, each arm 51, 52 comprises a median wall 60 interconnecting the side walls 56, 57, and perpendicular to the side walls 56, 57 and to the stiffeners 58, thereby increasing longitudinal rigidity of the arms 51, 52.

It can be appreciated from FIGS. 3 and 11 that, from a side and top view, each arm 51, 52 has a width that decreases towards the end of the arms 51, 52, thereby further reducing handle 2 weight without losing structural strength.

As a result of all the described features, the razor handle 2 has an enhanced design that improves finger gripping and provides more hand grasping comfort during shaving operations than known razor handles.

The invention claimed is:

1. A razor handle having a front end, a back end opposite the front end, an upper surface, a lower surface corresponding to a razor blade edge and opposite the upper surface, and a length in a longitudinal direction defined between the front end and the back end, the razor handle comprising:

a head portion for connection to a razor head; and a body portion for hand grasping of the razor handle;

wherein from a side view, the shape of the upper surface is arcuate in the longitudinal direction along the entire length of the razor handle and has a radius of curvature that continuously increases along the length of the razor handle, from approximately 2 cm at the back end to approximately 20 cm at a median location located at approximately half the length of the razor handle, and that continuously decreases along the length of the razor handle, from the median location towards the front end;

wherein from a side view, moving along the length of the handle in the longitudinal direction beginning adjacent the head portion, the shape of the lower surface transitions from concave and smooth to convex and including a first plurality of projections of a first material thereon to concave and smooth proximate the median location of the handle to convex to concave and including a second plurality of projections of a second material thereon to convex and smooth at the back end;

wherein from a side view, the upper surface and the lower surface define a height of the razor handle therebetween, and apart from the front and back ends, the smallest height of the body portion is located at approximately two thirds of the length of the body portion from the back end; and wherein the radius of curvature of the upper surface is always positive.

2. The razor handle according to claim 1, wherein the upper surface is from a side view convex in the longitudinal direction along the entire length of the razor handle.

3. The razor handle according to claim 2, wherein the shape of the upper surface is further arcuate and convex, in cross-section.

4. The razor handle according to claim 2, wherein the length of the razor handle is approximately 12 cm to approximately 14 cm.

5. The razor handle according to claim 2, wherein the radius of curvature continuously increases from approximately 2 cm to approximately 20 cm between the front end and the median location.

6. The razor handle according to claim 1, wherein from a side view the radius of curvature continuously increases from approximately 2 cm to approximately 20 cm between the front end and the median location.

7. The razor handle according to claim 1, wherein the length of the razor handle is approximately 12 cm to approximately 14 cm.

8. The razor handle according to claim 1, wherein the shape of the upper surface is further arcuate and convex, in cross-section.

9. The razor handle according to claim 8, wherein the radius of curvature is approximately 2 cm to approximately 20 cm between the front end and the median location.

10. A safety razor comprising:

a razor handle having a front end, a back end opposite the front end, an upper surface, a lower surface corresponding to a razor blade edge and opposite the upper surface, and a length in a longitudinal direction defined between the front end and the back end, the razor handle comprising:

a head portion for connection to a razor head; and a body portion for hand grasping of the razor handle;

wherein from a side view, the shape of the upper surface is arcuate in the longitudinal direction along the entire length of the razor handle and has a radius of curvature that continuously increases along the length of the razor handle, from approximately 2 cm at the back end to approximately 20 cm at a median location located at approximately half the length of the razor handle, and that continuously decreases along the length of the razor handle, from the median location towards the front end;

wherein from a side view, moving along the length of the handle in the longitudinal direction beginning adjacent the head portion, the shape of the lower surface transitions from concave and smooth to convex and including a first plurality of projections of a first material thereon to concave and smooth proximate the median location of the handle to convex to concave and including a second plurality of projections of a second material thereon to convex and smooth at the back end;

wherein from a side view, the upper surface and the lower surface define a height of the razor handle therebetween, and apart from the front and back ends, the smallest height of the body portion is located at approximately two thirds of the length of the body portion from the back end; and wherein the radius of curvature of the upper surface is always positive; and a razor head connected to the head portion.

11. A safety razor comprising:

a razor handle having a front end, a back end opposite the front end, an upper surface, a lower surface corresponding to a razor blade edge and opposite the upper surface, and a length in a longitudinal direction defined between the front end and the back end, the razor handle comprising:

a head portion for connection to a razor head; and a body portion for hand grasping of the razor handle;

wherein from a side view, the shape of the upper surface is arcuate in the longitudinal direction and convex along the entire length of the body portion, the upper surface having a radius of curvature that increases along the length of the razor handle, from approximately 2 cm at the back end to approximately 20 cm at a median location located at approximately half the length of the razor handle, and that decreases along the length of the razor handle, from the median location towards the front end;

wherein from a side view, the upper surface and the lower surface define a height of the razor handle therebetween, and apart from the front and back ends, the smallest height of the body portion is located at approximately two thirds of the length of the body portion from the back end;

wherein the shape of the upper surface is arcuate and convex in cross-section; and wherein from a side view, moving along the length of the handle in the longitudinal direction beginning adjacent the head portion, the shape of the lower surface transitions from concave and smooth to convex and including a first plurality of projections of a first material thereon to concave and smooth proximate the median location of the handle to convex to concave and including a second plurality of projections of a second material thereon to convex and smooth at the back end; and a razor head connected to the head portion.

* * * * *